US006637380B2

(12) United States Patent
Li

(10) Patent No.: US 6,637,380 B2
(45) Date of Patent: Oct. 28, 2003

(54) DIRECT HEATING DEVICE

(75) Inventor: Shanhua Li, Zhuhai (CN)

(73) Assignee: Zhuhai Velocity of South Technology Limited, Qianshan (CN)

( * ) Notice: Subject to any disclaimer, the term of this patent is extended or adjusted under 35 U.S.C. 154(b) by 0 days.

(21) Appl. No.: 10/188,985

(22) Filed: Jul. 3, 2002

(65) Prior Publication Data

US 2003/0164146 A1 Sep. 4, 2003

(30) Foreign Application Priority Data

Mar. 1, 2002 (CN) ..... 02106499 A

(51) Int. Cl.[7] ..... F22D 1/28

(52) U.S. Cl. ..... 122/390; 122/438; 122/442; 239/138

(58) Field of Search ..... 122/36, 390, 389, 122/403, 404, 438, 442; 239/135, 138, 310

(56) References Cited

U.S. PATENT DOCUMENTS 123,264 A * 1/1872 Korting ..... 417/174
1,801,811 A * 4/1931 Haber ..... 165/95
4,036,020 A * 7/1977 Bagley ..... 239/397.5
5,462,229 A * 10/1995 Tanaka et al. ..... 376/391
6,093,310 A * 7/2000 Swan ..... 208/113

* cited by examiner

*Primary Examiner*—Gregory Wilson
(74) *Attorney, Agent, or Firm*—Pennie & Edmonds LLP

(57) ABSTRACT

A direct heating device has a tubular main casing formed by a wall member. The main casing has a first end adapted to be coupled with a support structure, such as a monoblock fastening flange. One or more water inlets and out lets are provided in the wall member of the main casing. A funnel shaped sprinkler head is positioned inside the main casing. The bigger diameter end of the sprinkler head is coupled with the support structure. A critical nozzle in the shape of a long trumpet is coupled with the smaller diameter end of the sprinkler head. The direct heating device can also have a pressure relief damper, which has one end coupled to the main casing and the other end extending into the main casing. The main casing can have a double layer construction.

17 Claims, 4 Drawing Sheets

DIRECT HEATING DEVICE

FIELD OF THE INVENTION

The present invention relates to a water heating device. More particularly, the present invention relates to a heavy-duty fast-speed direct heating device which uses steam as its heat source.

BACKGROUND OF THE INVENTION

Water heating devices using steam as heat resources have two major categories, that is, the direct heating type and the indirect heating type. Indirect water heating devices have many limitations in actual production and application due to their low heat efficiency, low heating speed, large heat exchanger size, as well as their vulnerability to clogging due to incrustation.

Although direct water heating devices have the advantages of higher heat efficiency, higher heating speed, smaller size and no incrustation, they can generate enormous noises and shrewd shocks when the steam comes into contact and mixes with the cold water. Therefore, this type of heating devices are usually used where industrial production requires instant heating of a large amount of water.

FIG. 1 is a cross-sectional view of a conventional heater, which includes a casing 21, a steam inlet 24 on one end of the casing 21, and a water outlet 25 on the other end of the casing 21. A steam pipe 22 is coupled to one end of the casing 21. A water inlet 23 is provided on the wall of the casing 21. Such a conventional heater produces considerable noises during operation due to the lack of silencing and depressurization measures.

SUMMARY OF THE INVENTION

The present invention provides a direct heating device having advantages, such as low working noise and shock level, high heat efficiency, fast heating speed, small size, high incrustation resistance, high reliability, low maintenance, long service life, flexible and convenient use, as well as high or super high temperature.

The direct heating device can comprise a main casing. The main casing can have a first end adapted to be coupled with a support structure, such as a monoblock fastening flange. One or more water inlets can be formed in the wall member of the main casing near its first end. One or more water outlets can be provided at the second end of the main casing. A sprinkler head can be provided inside the main casing. The sprinkler head can be in a funnel shape having its large diameter end coupled with the support structure, such as the monoblock fastening flange. A critical nozzle in the shape of a long trumpet can be coupled with the small diameter end of the sprinkler head.

In the direct heating device, the water inlets can be spaced away from the first end of the main casing. For example, the water inlets can be spaced from the first end for a distance of about one fourth of the casing length. Additionally or alternatively, the water inlets can be equally spaced on the wall member of the main casing. The number of the water inlets can range from two to six. Additionally or alternatively, the water outlets can be provided in the wall member near the second end of the main casing. The number of the water outlets can range from two to six.

If desired, a high pressure mixing chamber can be provided between the critical nozzle and the water outlets. The mixing chamber can be a round tube.

Optionally, an elbow portion can be mounted to the support structure, for example, on an opposite side of the monoblock fastening flange.

Additionally or alternatively, the main casing can be a double layer construction and comprise outer and inner wall members forming a silencing and shock-isolation chamber therebetween. One or more water inlets can be formed in the inner wall member. The number of the water inlets in the inner wall member can be up to six.

Additionally or alternatively, a pressure relief damper can be provided in the direct heating device. The pressure relief damper can comprise a tail end coupled with the main casing and a tapered end extending into the main casing.

These and other features and advantages of the present invention will be readily apparent from the following detailed description of the invention, the scope of the invention being set out in the appended claims.

BRIEF DESCRIPTION OF THE DRAWINGS

The detailed description of the present invention will be better understood in conjunction with the accompanying drawings, wherein like reference numbers represent like elements, as follows.

DETAILED DESCRIPTION OF THE EMBODIMENTS

Exemplary direct heating devices embodying the principles of the present invention are shown throughout the drawings. In the following description of various embodiments of direct heating devices, same or similar elements or components thereof are designated with the same reference numbers and redundant description is omitted.

Figure 2:
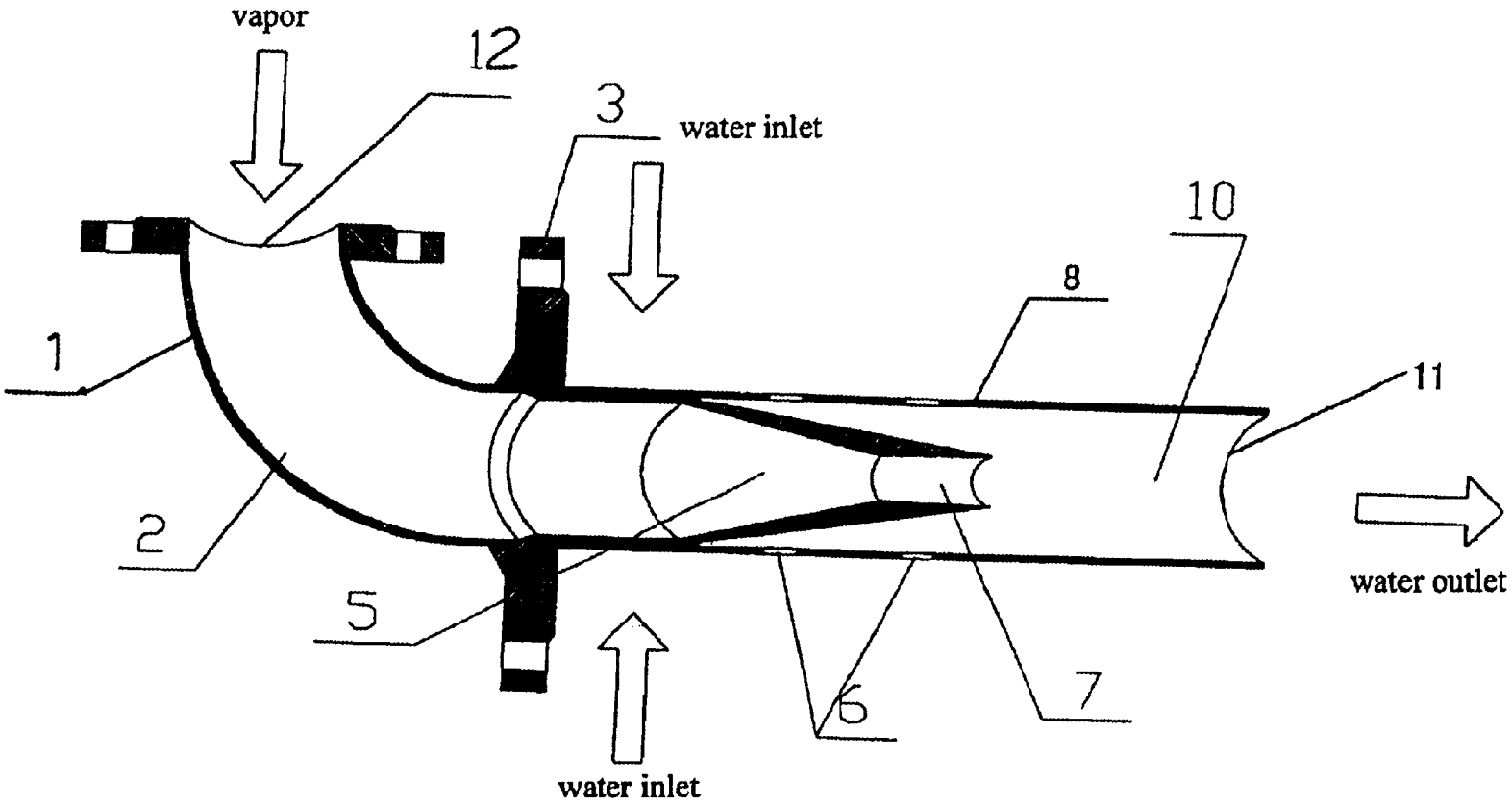
FIG. 2 is a cross-sectional view of a first embodiment of the water heating device of the invention.

FIG. 2 illustrates a first embodiment of the direct heating devices 1. The direct heating device 1 can comprise a main casing 8 formed by a wall member and having first and second ends. The first end of this main casing 8 can be adapted to be coupled with the support structure 3, such as a monoblock fastening flange as shown in FIG. 2. In one embodiment, the main casing 8 can be a tubular member. In another embodiment, the main casing 8 can be in the shape of a round tube. It will be appreciated that other alterations to the main casing 8, such as changes to its shape and size, can also achieve the same or similar results and therefore are within the scope of the present invention.

One or more water inlets 6 can be provided in the wall member of the main casing 8. In one embodiment, the water inlets 6 can be positioned away form the first end of the main casing 8. In an exemplary embodiment, the water inlets 6 can be spaced from the first end of the main casing 8 for a distance of about one fourth of the casing length. In another embodiment, the water inlets 6 can be equally spaced from each other, either along the longitudinal direction or circumferential direction of the main casing 8. The number of the water inlets 6 can range from two to six. In an exemplary embodiment, four water inlets 6 can be provided in the main casing 8. It will be appreciated that other alterations to the water inlets 6, such as changes to their number and location, can also achieve the same or similar results and therefore are within the scope of the present invention.

One or more water outlets 11 can be provided on the main casing 8. In one embodiment, the water outlet 11 can be the open end at the second end of the main casing 8. In another embodiment the water outlets 11 can be formed in the wall member of the main casing 8. The water outlets 11 can be equally spaced from each other, either along the longitudinal or the circumferential direction of the main casing 8. The number of the water outlets 11 can range from two to six. In an exemplary embodiment, four water outlets 11 can be provided in the main casing 8. It will be appreciated that other alterations to the water outlets 11, such as changes to their number and location, can also achieve the same or similar results and therefore are within the scope of the present invention.

In one embodiment, a high pressure mixing chamber 10 can be provided in the main casing 8 between the critical nozzle 7 and the water outlets 11. In an exemplary embodiment, the high pressure mixing chamber 10 can be in the shape of a round tube.

A conduit member 5 can be provided inside the main casing 8 for introducing a heat source, such as steam, into the heating device 1. In one embodiment, the conduit member 5 can be a sprinkler head having one of its ends mounted to the first end of the main casing 8 or the support structure, such as a monoblock fastening flange 3 as shown in FIG. 2. The other end of the sprinkler head 5 extends freely into the main casing 8.

The conduit member 5 can have various shapes. In one embodiment, the interior of the conduit member 5 can form a funnel-shaped chamber. In an exemplary embodiment as shown in FIG. 2, the interior of the conduit member 5 can be tapered gradually when the conduit member 5 further extends into the main casing 8. Additionally or alternatively, the exterior of the conduit member 5 can have a smooth transitional contour in the longitudinal cross-section. In one embodiment, the conduit member 5 can have a conical exterior. In an exemplary embodiment as shown in FIG. 2, the larger diameter end of the conduit member 5 can be coupled with the first end of the main casing 8 or a support structure, such as the monoblock fastening flange 3. In another embodiment, the interior and the exterior of the conduit member 5 can be tapered in different degrees. In an exemplary embodiment as shown in FIG. 2, the interior of the conduit member 5 can taper in a greater degree than the exterior of the conduit member 5. It will be appreciated that other alterations to the conduit member 5, such as changes to its shape and size, can also achieve the same or similar results and therefore are within the scope of the present invention A critical nozzle 7 can be coupled with the free end of the sprinkler head 5. The critical nozzle 7 can have various shapes. In one embodiment, the critical nozzle 7 can be flared toward its free end. In one exemplary embodiment, the critical nozzle 7 can have the shape of a long trumpet. In another exemplary embodiment as shown in FIG. 2, the diameter of the trumpet-shaped interior increases gradually toward the free end of the critical nozzle 7. Additionally or alternatively, the exterior of the critical nozzle 7 can have a smooth transitional profile in the longitudinal cross-section. In one embodiment, the critical nozzle 7 can have a conical exterior. Additionally or alternatively, the exterior and interior of the critical nozzle 7 can taper in different degrees. In another embodiment, the exterior and interior of the critical nozzle 7 can taper in opposite directions, such as shown in FIG. 2. It will be appreciated that other alterations to the critical nozzle 7, such as changes to its shape and size, can also achieve the same or similar results and therefore are within the scope of the present invention.

In an exemplary embodiment as shown in FIG. 2, the interior of the sprinkler head 5 and the critical nozzle 7 can taper in different degrees. In an exemplary embodiment, the interior of the sprinkler head 5 can taper in a larger degree than the critical nozzle 7. Additionally or alternatively, the interior of the sprinkler head 5 and the critical nozzle 7 can taper in opposite directions. In an exemplary embodiment as shown in FIG. 2, the small interior ends of the sprinkler head 5 and the critical nozzle 7 can be coupled together to join the sprinkler head 5 with the critical nozzle 7.

Additionally or alternatively, the exterior of the sprinkler head 5 and the critical nozzle 7 can taper in various manners. In an exemplary embodiment as shown in FIG. 2, the exterior of the sprinkler head 5 and the critical nozzle 7 can taper continuously.

In another embodiment, a heat conduit 2 can be provided to introduce a heat source, such as steam, into the heating device 1. The heat conduit 2 can be adapted to be mounted onto the support structure. In one embodiment, the heat conduit 2 can be formed to be fluid communication with the interior of the conduit member 5. In an exemplary embodiment as shown in FIG. 2, the heat conduit 2 can be in an elbow shape and mounted on the other side on the monoblock fastening flange 3. A heat inlet 12 can be formed at the free end of the heat conduit 2 and adapted to connect to a heat source, such as a steam source. It will be appreciated that other alterations to the heat conduit 2 and the heat inlet 12, such as changes to their shape and size, can also achieve the same or similar results and therefore are within the scope of the present invention.

Working process of this invention will now be described as follows:

The direct heating device 1 of this invention can be put into a water tank or reservoir. Water in the water tank or reservoir will enter the high pressure mixing chamber 10 inside the main casing 8 through the water inlets 6 provided on the wall member of the main casing 8. A pressurized steam, can be introduced into the heat conduit 2 through the heat inlet 12. The pressured steam can pass through the sprinkler head 5 and be sprayed out from the critical nozzle 7. The steam can then enter the high pressure mixing chamber 10 which is filled with water. At the same time, a pressure drop occurs at the critical nozzle 7 so that water can be drawn from the water tank or reservoir into the high pressure chamber 10 through the water inlets 6 by this negative pressure.

In the high pressure mixing chamber 10, fluids of two different phases will exchange heat and momentum. In other words, steam will transfer its heat to water to raise the water temperature. In addition, steam will transfer its momentum and kinetic energy to water to raise the water pressure and potential energy. The mixed fluid will flow out of the water outlets 11 in the steam spray-out direction and return to the water tank or reservoir. In this way, the water in the water tank or reservoir will be driven by the steam and continuously flow into the heating device 1 to mix with the steam and be heated thereby.

Because the contact and mixing of the steam, as a heat source, and the water to be heated occur in an ultrasonic state, the heating device 1 of this invention has such advantages as low working noise and shock level, high heat efficiency, fast heating speed, small size, high incrustation resistance, high reliability, low maintenance, long service life, flexible and convenient use, as well as high or super high temperature.

Figure 3:
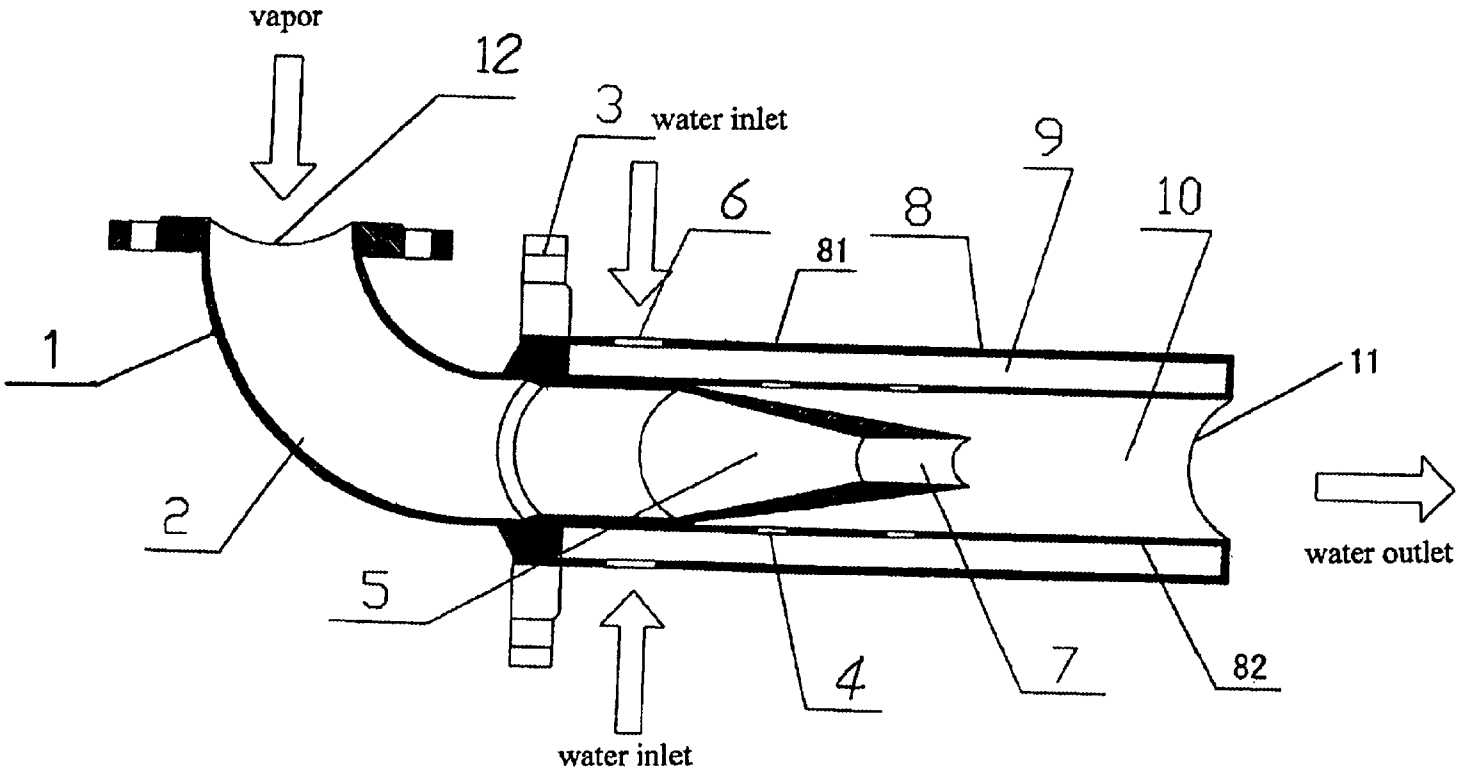
FIG. 3 is a cross-sectional view of an alternative embodiment of the water heating device of the invention.

FIG. 3 shows an alternative embodiment of the direct heating device 1. In this embodiment, the main casing 8 can have a double layer construction. For example, the main casing 8 can comprise outer and inner wall members 81 and 82, which can form a silencing and shock-isolation chamber 9 therebetween. The wall members 81 and 82 can be coupled to each other in various ways. In an exemplary embodiment as shown in FIG. 3, the wall members 81 and 82 can be coupled to each other by a fastening flange 3.

The outer and inner wall members 81 and 82 can be formed in various shapes. In one embodiment, the wall members 81 and 82 can have a circular shape in the transverse cross-section. In an exemplary embodiment, such as shown in FIG. 3, the wall members 81 and 82 can be concentric cylindrical members extending between the first and second ends of the main casing 8. The silencing and shock-isolation chamber 9 so formed can have a donut-shape in the transverse cross-section. In another exemplary embodiment, the inner wall member 81 can expand for less than the entire length of the main casing 8. It will be appreciated that other alterations to the wall members 81 and 82 and/or the silencing and shock-isolation chamber 9, such as changes to their shape and size, can also achieve the same or similar results and therefore are within the scope of the present invention.

In one embodiment, one or more water inlets 6 can be provided on the outer wall member 81. The wall inlets 6 can be formed similarly to those on the main casing 8 as described above. In another embodiment, one or more water inlets 4 can be provided on the inner wall member 82. The wall inlets 4 can be formed similarly to the water inlets 6 on the outer wall member 81 as described above. For example, water inlets 4 can be equally spaced on the inner wall member 82, along either a longitudinal or a circumferential direction thereof. In an exemplary embodiment, the water inlets 4 can be formed near the first end of the main casing 8. The number of the water inlets 4 can range from two to six. In another exemplary embodiment, four water inlets 4 can be provided on the inner wall member 81. It will be appreciated that other alterations to the water inlets 4 and 6, such as changes to their number and location, can also achieve the same or similar results and therefore are within the scope of the present invention.

In this embodiment, water can enter the high pressure mixing chamber 10 after flowing through the water inlets 6 on the outer wall member 81, the silencing and shock-isolation chamber 9, and the water inlets 4 on the inner wall member 82. The silencing and shock-isolation chamber 9 is capable of reducing the working noise and shock level independent or in combination with the sprinkler head 5 and/or critical nozzle 7.

Figure 1:
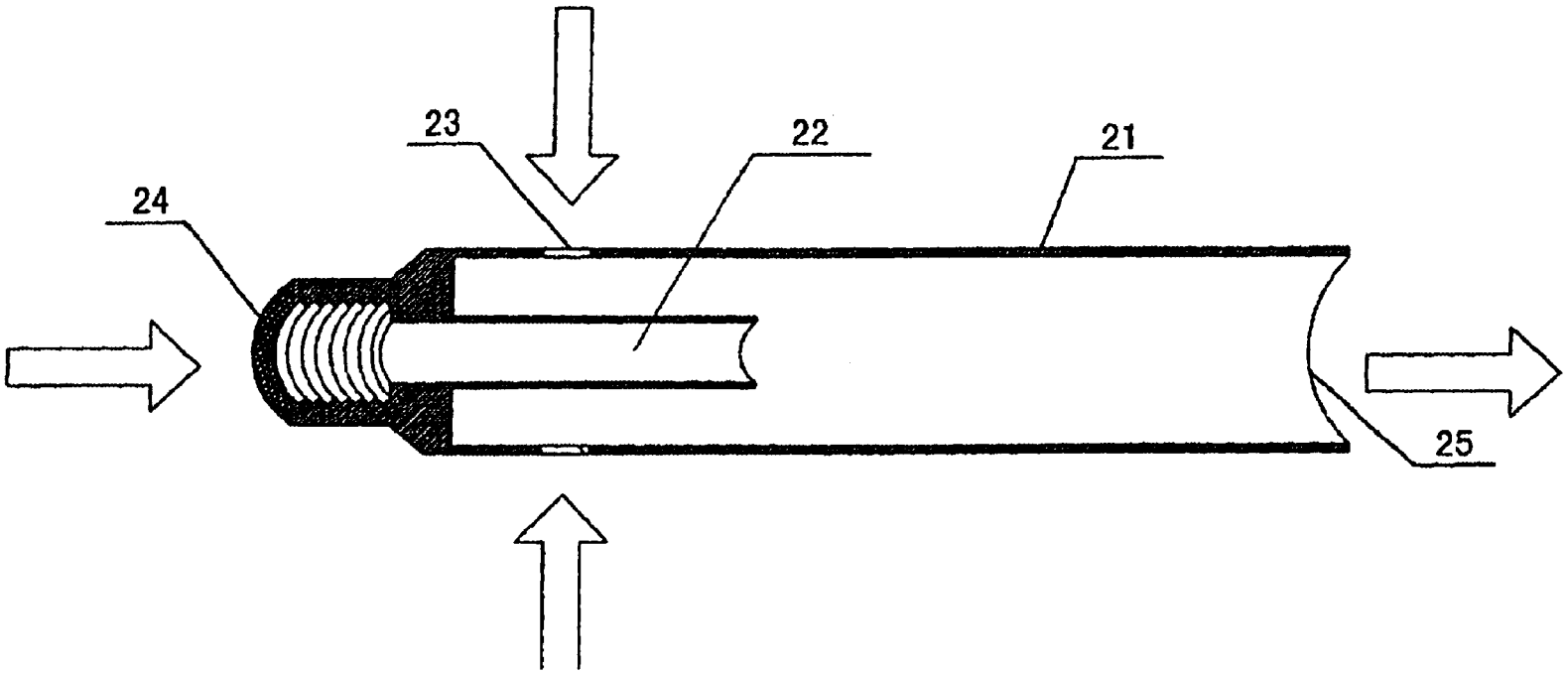
Fig.1 PRIOR ART
FIG. 1 is cross-sectional view of a conventional water heater.
Figure 4:
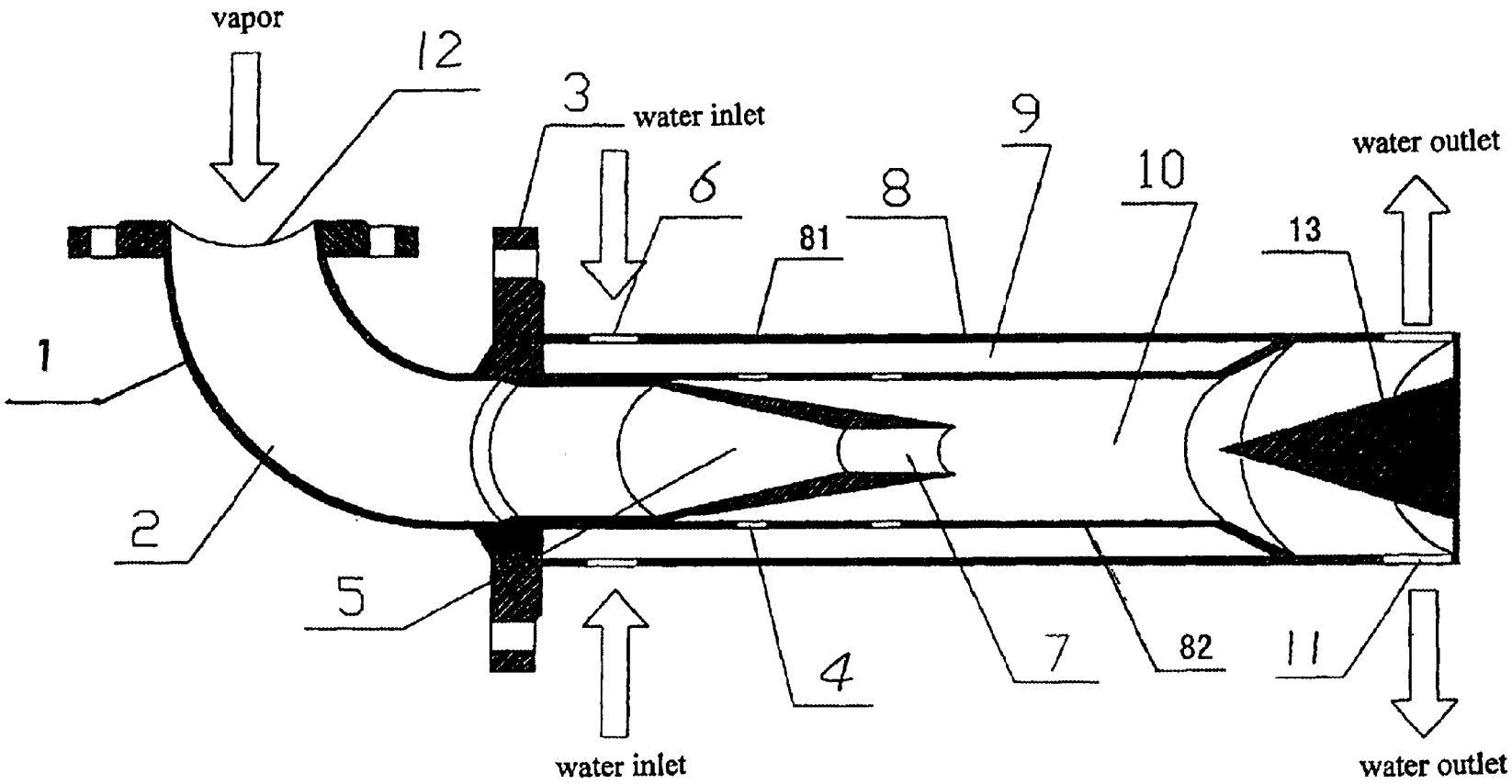
FIG. 4 is a cross-sectional view of a further embodiment of the water heating device of the invention.

FIG. 4 illustrates a further embodiment of the heating device 1. In this embodiment, a pressure relief damper 13 can be provided inside the main casing 8 to reduce the working noise and shock level of the heating device 1. Although FIG. 4 also illustrates a double layer construction of the main casing 8, the pressure relief damper 13 can operate independently from the double layer construction of the main casing 8. In other words, the pressure relief damper 13 can be used in the heating device 1 shown in FIG. 1 to reduce the working noise and shock level thereof.

The pressure relief damper 13 can be formed in various manners. For example, the pressure relief damper 13 can have a tapered end extending inside the main casing 8. In an exemplary embodiment, such as shown in FIG. 4, the tapered end can have a conical shape with its apex pointing away from the second end of the main casing 8. The pressure relief damper 13 can be coupled to the main casing 8 by various conventional means. In an exemplary embodiment, as shown in FIG. 4, the pressure relief damper 13 can have a tail end adapted to be coupled with the second end of the main casing 8. It will be appreciated that other alterations to the pressure relief damper 13, such as changes to its shape and location, can also achieve the same or similar results and therefore are within the scope of the present invention.

In this embodiment, one or more water outlets 11 can be provided at the open end of the main casing 8 between the pressure relief damper 13 and the wall member of the main casing 8. Additionally or alternatively, one or more water outlets 11 can be formed in the circumferential wall member of the main casing 8. The number of the water outlets 11 can range from two to six. In an exemplary embodiment, such as shown in FIG. 4, four water outlets 11 can be formed in the circumferential wall member of the main casing 8. When water flows out of the water outlets 11 through the pressure relief damper 13, shock of the heating device 1 can be reduced by the depressurization from the pressure relief damper 13. Equally spaced water outlets 11 can also contribute to the reduction of the shock level.

In an exemplary embodiment, such as shown in FIG. 4, the pressure relief damper 13 can be used together with a double-layered main casing 8. In such an embodiment, water can enter the high pressure mixing chamber 10 after flowing through the water inlets 4 on the outer wall member 81, the silencing and shock-isolation chamber 9, and the water inlets 6 on the inner wall member 82 and then exit from the water outlets 11.

The silencing and shock-isolation chamber 9 can operate to reduce the working noise and shock level in the heating device 1, while the pressure relief damper 13 can depressurize the shock level of the heating device 1.

Compared with conventional heaters, the direct heating device 1 has various advantages, such as low working noise and shock level, high heat efficiency, fast heating speed, small size, high incrustation resistance, high reliability, low maintenance, long service life, as well as flexible and convenient use. The direct heating device 1 can be widely used in water heating and supply systems of the various fields.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications, and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiment is therefore to be considered in all respects as illustrative and not restrictive, the scope of the invention being indicated by the appended claims, and not limited to the foregoing description.

What is claimed is:

1. A direct heating device comprising:

a tubular main casing comprising a first end adapted to be coupled with a support structure, water inlets formed in a wall member of the main casing and spaced away from the first end of the main casing, and water outlets provided at a second end of the main casing;

a funnel shaped sprinkler head provided inside the main casing and having large and small diameter ends, the large diameter end of the sprinkler head being coupled with the support structure; and a trumpet shaped critical nozzle being coupled with the small diameter end of the sprinkler head.

2. The direct heating device according to the claim 1 further comprising a tubular mixing chamber located between the critical nozzle and the water outlets.

3. The direct heating device according to the claim 1, wherein the water inlets are equally positioned on the wall member of the main casing and spaced from the first end for about one fourth the length of the main casing, and the number of water inlets ranges from two to six.

4. The direct heating device according to the claim 1, wherein the water outlets are provided in the wall member of the main casing, and the number of water outlets ranges from two to six.

5. The direct heating device according to the claim 1, wherein an elbow member is connected on an opposite side of the support structure.

6. The direct heating device according to claim 1, wherein the main casing has a double layer construction and comprises outer and inner wall members forming a silencing and shock-isolation chamber therebetween.

7. The direct heating device according to the claim 6, wherein at least one water inlet is formed in the inner wall member.

8. The direct heating device according to the claim 6 further comprising a pressure relief damper, which comprises a tapered end extending into the main casing and a tail end coupled with the main casing.

9. The direct heating device according to the claim 1 further comprising a pressure relief damper, which comprises a tapered end extending into the main casing and a tail end coupled with the main casing.

10. A direct heating device comprising:

a casing member comprising a first end adapted to be mounted onto a support structure and a water inlet and a water outlet formed in a wall member of the casing member;

a sparkler head having a first end adapted to be mounted to the support structure and a second end extending inside the casing member, the sparkler head being tapered from its first end toward its second end; and a critical nozzle being coupled with the second end of the sprinkler head.

11. The direct heating device according to claim 10, wherein the critical nozzle is flared toward its free end.

12. The direct heating device according to claim 10, wherein the casing member comprises a tubular body and an open end at the second end of the casing member, and the open end forms the water outlet.

13. The direct heating device according to claim 10, wherein the casing member has a double layer construction and comprises outer and inner wall members forming a silencing and shock-isolation chamber therebetween.

14. The direct heating device according to the claim 10 further comprising a pressure relief damper, which comprises a tapered end extending into the casing member and a tail end coupled with the casing member.

15. A direct heating device comprising:

a casing member formed by a wall member and comprising a water inlet and a water outlet formed in the wall member of the casing member;

a conduit member having a first end adapted to receive a heat source and a second end extending inside the casing member, the conduit member being tapered from its first end toward its second end; and a critical nozzle coupled with the second end of the conduit member.

16. The direct heating device according to the claim 15, wherein the critical nozzle is flared toward its free end.

17. The direct heating device according to claim 15, wherein the first end of the casing member and the first end of the conduit member are integrally formed.

* * * * *